United States Patent [19]

Siemund et al.

[11] 4,077,083

[45] Mar. 7, 1978

[54] RETAINER FOR A SPONGE RUBBER MOP

[75] Inventors: Herbert A. Siemund; Earl Wilson, both of Chicago, Ill.

[73] Assignee: Greenview Manufacturing Company, Chicago, Ill.

[21] Appl. No.: 702,522

[22] Filed: Jul. 6, 1976

[51] Int. Cl.[2] ..... A47L 13/46

[52] U.S. Cl. ..... 15/244 R

[58] Field of Search ..... 15/114, 116 A, 118, 15/119 A, 121, 244 R, 244 A; 401/10, 18, 23, 25–27, 196, 202–206, 261–263, 266

[56] References Cited

U.S. PATENT DOCUMENTS

| | | | |
|---|---|---|---|
| 1,665,727 | 4/1928 | Campbell | 15/244 A |
| 2,249,912 | 7/1941 | Oxley | 15/244 R X |
| 2,533,706 | 12/1950 | Acocella et al. | 15/244 R X |
| 2,614,556 | 10/1952 | Staunt | 15/244 R UX |
| 3,012,265 | 12/1961 | Courtenay | 15/244 R |
| 3,897,603 | 8/1975 | Brennenstuhl | 15/244 R |

FOREIGN PATENT DOCUMENTS

| | | | |
|---|---|---|---|
| A56,907 | 7/1952 | France | 15/244 R |

*Primary Examiner*—Daniel Blum
*Attorney, Agent, or Firm*—Silverman & Cass, Ltd.

[57] ABSTRACT

A sponge mop retainer is attached to the end of a handle with a sponge member removably secured within the retainer. The retainer keeps the sponge member from rolling out when the mop is in use by tending to adhere to a surface while it allows the sponge member to be removed when the sponge member is worn out or dirty. The sponge member has four opposed longitudinal slits, one on each of four opposed surfaces. The retainer has a top wall and two side walls with the bottom edges of the two side walls having flanges which project inwardly, substantially toward one another. The free edges of each of the flanges have enlargements, substantially along their length, of a greater thickness than the thickness of the flanges which are engaged in two of the opposed slits to oppose movement of the sponge member away from the retainer. The enlargements, which may be in the form of barbs, enable the sponge member to withstand the friction forces involving in cleaning a surface without becoming disengaged from the retainer.

6 Claims, 4 Drawing Figures

FIG. 1
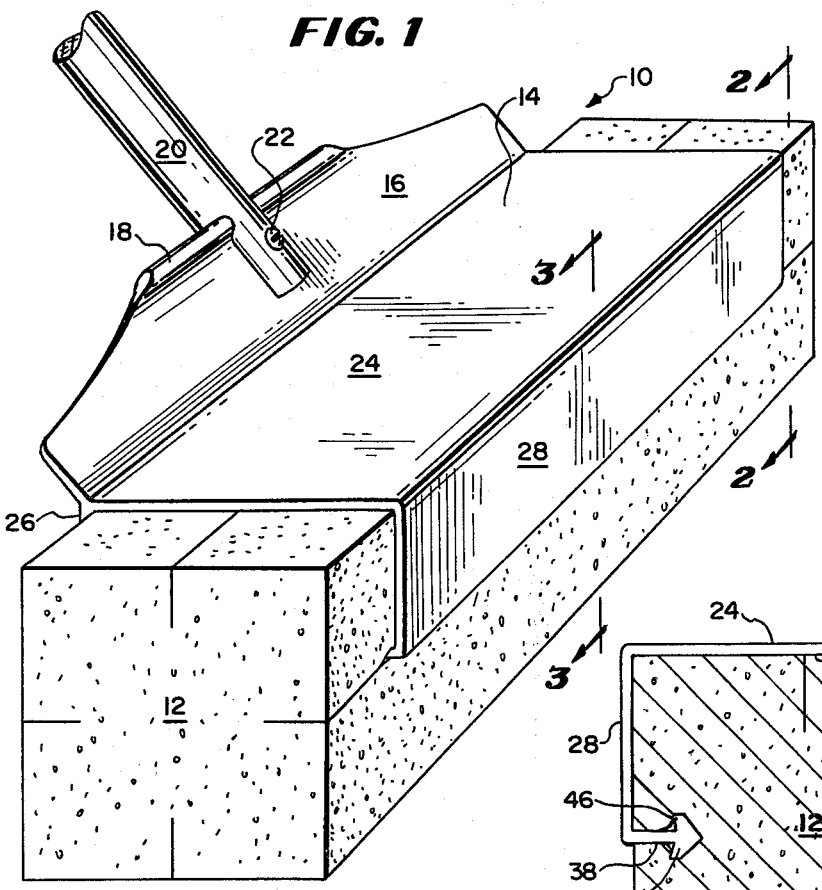
FIG. 2
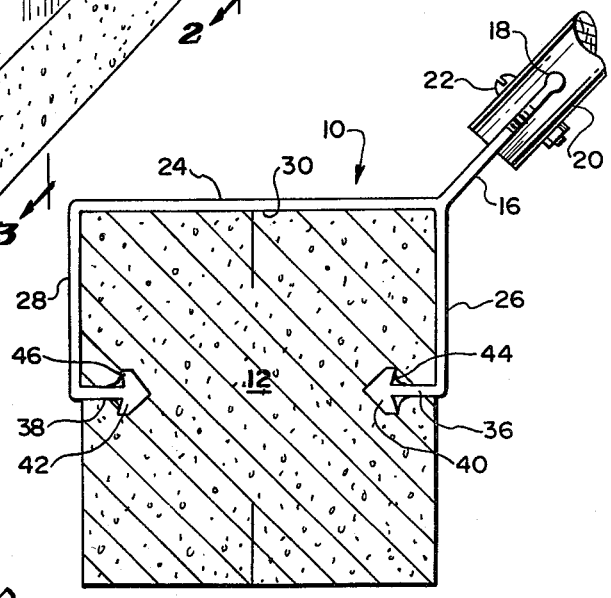
FIG. 3
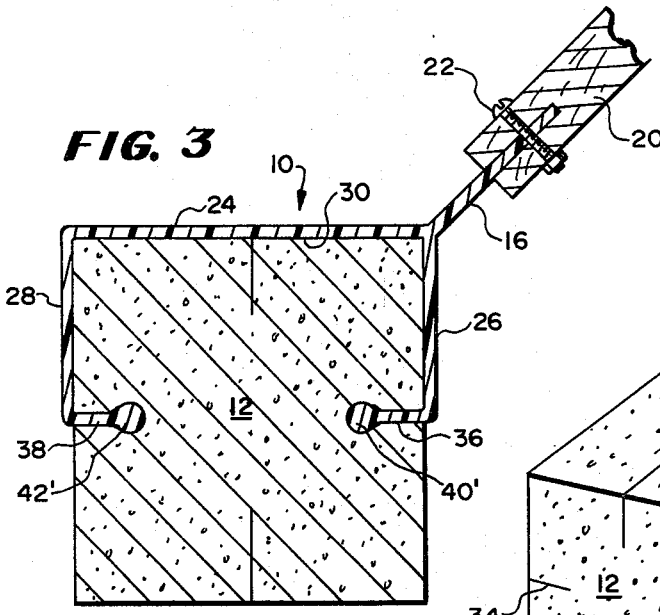
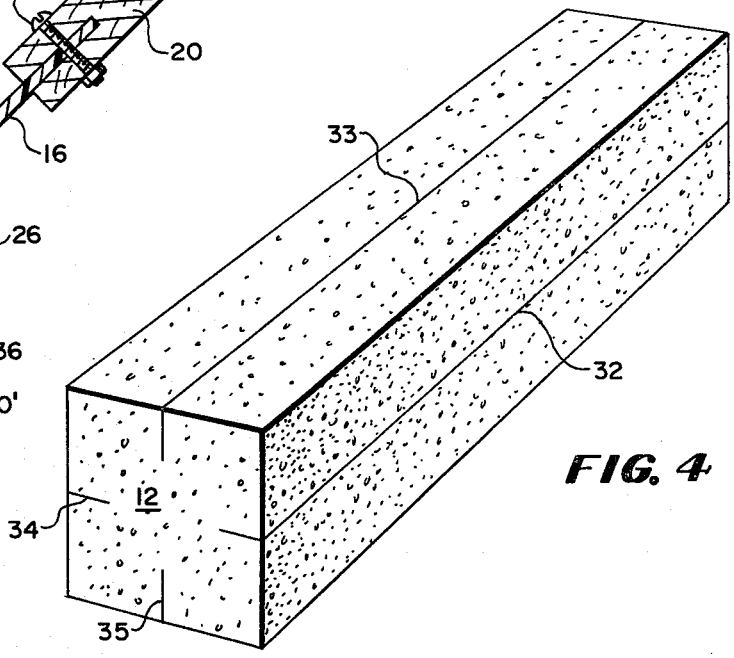
FIG. 4

RETAINER FOR A SPONGE RUBBER MOP

BACKGROUND OF THE INVENTION

The invention relates to a sponge rubber mop and more particularly is concerned with a retainer for removably retaining the sponge rubber member.

In utilizing a sponge rubber mop the sponge member must securely be retained within the mop head so the sponge member will be held in the mop head against the friction forces exerted against it when it is in use and moved across a surface. At the same time, the sponge member must be capable of being removed when the exposed surface of the sponge member is dirty or worn out. Preferably, the sponge member may be reversed in the mop head so that at least two separate surfaces may be utilized in the mopping operation before the member is cleaned or disposed of.

The problem presented by a removable sponge mop member, is that it is difficult to retain it securely enough so that it will not roll out when it is being used, and yet allow it easily to be removed for replacement or rotating of the exposed mopping surface. In applying wax, for example, the wax may dry and become sticky, seize the engaged surface and pull the mop member out.

One sponge mop which has a sponge member which may be rotated to utilize all four of the sponge member faces is described in U.S. Pat. No. 3,012,265. In this mop the sponge member has lengthwise grooves which are pinched or resiliently squeezed by the rolled edges of the flanges of the retainer. If the friction force becomes excessive during use, the pinching force exerted by the retainer may not be sufficient, and the sponge member may roll out of the retainer.

A sponge retainer having inwardly opposed flanges is shown and described in U.S. Pat. No. 3,096,534. The inwardly extending flanges are of a single thickness and are engaged in channels or slits in the sponge member. This sponge retainer, however, is specifically directed to a vertical pressing operation and not to a side to side engagement causing friction on the exposed surface of the sponge member. If this sponge retainer were moved from side to side the large flat surface of the sponge member in relation to the small slits in the thin edge would cause the sponge member to roll out of the retainer under a small frictional force.

SUMMARY OF THE INVENTION

The above and other disadvantages of prior art sponge mops are overcome in accordance with the present invention by providing a retainer which securely holds the sponge member and prevents it from rolling out of the retainer under frictional engagement, while allowing the sponge member to be easily reversed or replaced. The sponge mop has a retaining member with a top wall and two side walls, the side walls having two oppositely opposed and inwardly bent flanges which engage in longitudinal slits in opposing side surfaces of the sponge member. The free edge of each flange has an enlargement of a substantially greater thickness than the rest of the flange along substantially the entire length of the edge. The enlargements may be of a circular or wedge-shaped cross section with rearwardly facing sharp edges which will oppose movement of the sponge member away from the retainer when the mop is moved from side to side. The retainer preferably has a handle attached to its top wall and disposed transverse to the free edges of the flanges to allow the sponge member to be moved back and forth in the cleaning process.

BRIEF DESCRIPTION OF THE DRAWINGS

FIG. 1 is a perspective view of the sponge mop with the sponge inserted in the retainer;

FIG. 2 is a sectional side view of a first embodiment of the enlargements of the retainer taken along line 2—2 of FIG. 1;

FIG. 3 is a view similar to that of FIG. 2 of a second embodiment of the enlargements of the retainer taken along line 3—3 of FIG. 1; and FIG. 4 is a perspective view of the sponge member adapted to be used in the retainer.

DESCRIPTION OF THE PREFERRED EMBODIMENTS

As indicated above, the invention is concerned with a sponge mop retainer having flanges with enlargements adapted to retain a sponge member against frictional forces and simultaneously allow the sponge member easily to be removed to change the operational surface or to replace the sponge member.

Referring now to FIG. 1, the sponge mop of the invention is designated generally at 10. The sponge mop 10 has a sponge member 12 held in a retainer 14. The retainer 14 has an angular extending flange 16 extending from a top edge of the retainer.

The flange 16 preferably has a rounded edge 18 along the free edge of the flange which is open in the center of the flange to allow a handle 20 to be attached to the retainer 14. The handle 20 may be made from any convenient material and may be attached to the retainer 14 by any convenient method such as a bolt or pin 22 extending through the handle and the flange 16. The rounded edge 18 strengthens the flange 16.

The retainer 14 is most clearly illustrated in FIGS. 2 and 3. The retainer has a generally rectangular top wall 24. The top wall has two downwardly extending side walls 26 and 28. The sponge member 12 preferably is rectangular in cross section and the walls 24, 26 and 28 preferably define a rectangular recess 30 within which the upper half of the sponge 12 is engaged. The flange 16 is attached along the edge defined by the walls 24 and 26, but, of course, could be disposed on the opposite edge, the top wall or the side walls, as desired.

The retainer 14 is made from any convenient material, but preferably may be made from a unitary piece of plastic. The retainer 14 may be made by any convenient method, such as molding or extruding, and may include all or a portion of the handle 20 or a socket for the handle 20.

The sponge member 12, most clearly seen in FIG. 4, has two pairs of opposed longitudinal slits 32 and 34, and 33 and 35 in the walls or surfaces, extending the length thereof and substantially parallel to one another. The longitudinal slits described are ones in which there is a cut with a minimum removal of material. The sponge member 12 preferably is slightly larger in cross section than the recess 30 to provide a snug fit.

Referring again to FIGS. 2 and 3, each of the side walls 26 and 28 have an inwardly extending flange 36 and 38, respectively, extending from their bottom edge towards one another and being of a depth substantially equal to the depth of the slits 32, 33, 34 and 35 of the sponge member 12.

To retain the sponge member 12 within the retainer 14, when the sponge mop 10 is moved from side to side, against the frictional forces exerted against the exposed surface of the sponge member 12, each of the flanges 36 and 38 is provided with an enlargement 40 and 42, respectively, along the inner free edge thereof. The enlargements 40 and 42, are substantially wedge-shaped in cross section. Each of the enlargements has a rearwardly transversely extending flange or barb, 44 and 46, respectively, along the rear edge of the enlargement on one or both sides of the flanges 36 and 38. The flanges or barbs 44 and 46 may be substantially perpendicular or inclined to oppose movement of the sponge member 12 from the retainer 14.

A second embodiment of the enlargements 40' and 42', respectively, is best illustrated in FIG. 3. The enlargements 40' and 42' are substantially circular in cross section and have a diameter very much larger than the body of the flanges 36 and 38.

Only two embodiments of the enlargements have been specifically described; however, they may be of many configurations within the scope of the invention. The retainer 24 and the sponge 12 are shown with a substantially rectangular cross section; however, this is not critical since the invention is directed to the inwardly extending flanges 36 and 38 with the enlargements 40 and 42 along the edges thereof to retain the sponge member within the retainer 24, and not to any particular shape of the sponge member 12 and the retainer 24.

Although the flanges 36 and 38 are shown disposed in a generally planar arrangement, they may be disposed at different angles as long as the enlargements are buried within the slits of the sponge member. Two pairs of slits are provided so that all four sides of the sponge member may be utilized as a cleaning surface; however, the invention may be practiced with only a single pair of opposed slits in the sponge member.

Many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. In a sponge mop having a sponge member with at least two opposed longitudinal surfaces, each of said surfaces having a longitudinal outwardly opening slit, the slits lying generally in the same plane, a sponge retaining member having an integrally formed generally channeled-shaped structure opening downwardly and having a top and side walls, the side walls terminating adjacent their bottom edges in inwardly extending flanges extending substantially perpendicular to said side walls, said flanges having a first thickness and free inner edges, said slits having a substantially constant width less than said first thickness, said flanges engaged within a pair of said opposed slits of the sponge member to engage the sponge member with the free inner edges substantially buried in the sponge member, the improvement comprising:

said free inner edges having enlargement means substantially along substantially the entire length thereof of greater thickness than the flanges substantially surrounded by said sponge member for resisting withdrawal of the flanges from said slits.

2. In a sponge mop as claimed in claim 1 wherein:

said enlargement means include means directed laterally and having structure opposing movement of said flanges away from said slits.

3. In a sponge mop as claimed in claim 1 further including:

handle means connected to said sponge retaining member, said handle means disposed substantially transverse to said free edges of said flanges.

4. In a sponge mop as claimed in claim 1 wherein:

said enlargement means have a substantially wedge-shaped cross section with a pointed edge of each of said wedges opposing one another and each wedge having at least one upstanding rearward flange engaged internally within said slits so as to oppose movement of said sponge member away from said retaining member.

5. In a sponge mop as claimed in claim 1 wherein:

said enlargement means have a substantially circular cross section.

6. A sponge retaining member, adapted to retain a sponge member having at least two opposed longitudinal surfaces with longitudinal outwardly opening slits, the slits lying generally in the same plane, said retaining member having an integrally formed generally channeled-shaped structure opening downwardly and having a top and side walls, the side walls terminating adjacent their bottom edges in upwardly extending substantially perpendicular flanges having a first thickness, said flanges having free inner edges, said slits having a substantially constant width less than said first thickness, said flanges adapted to engage in said sponge member slits, the improvement comprising:

said flange free inner edges having enlargement means along substantially the entire length thereof of a second thickness greater than said first thickness and adapted to resist withdrawal of a sponge member from said retainer, said enlargement means have a substantially wedge-shaped cross section with a pointed edge of each of said wedges opposing one another and each wedge having at least one upstanding rearward flange adapted to be engaged internally within said slits to oppose movement of said flanges away from said slits; and handle means connected to said sponge retaining member, said handle means disposed substantially transverse to said free edges of said flanges.

* * * * *